US006253912B1

(12) United States Patent
O'Neill et al.

(10) Patent No.: US 6,253,912 B1
(45) Date of Patent: Jul. 3, 2001

(54) METHOD FOR SEPARATING PACKAGES

(75) Inventors: Trevor O'Neill; John Cardiff, both of Waterford (IE)

(73) Assignee: Bausch & Lomb Incorporated, Rochester, NY (US)

( * ) Notice: Subject to any disclaimer, the term of this patent is extended or adjusted under 35 U.S.C. 154(b) by 0 days.

(21) Appl. No.: 09/538,883

(22) Filed: Mar. 30, 2000

(51) Int. Cl.[7] ..... B65D 85/38

(52) U.S. Cl. ..... 206/5.1; 53/396; 206/461; 493/73

(58) Field of Search ..... 53/396, 453, 492; 206/5.1, 461, 469, 528–540; 493/73

(56) References Cited

U.S. PATENT DOCUMENTS 3,780,856 * 12/1973 Braverman ..... 206/461
3,844,408 * 10/1974 Relyea ..... 206/534
4,998,623 * 3/1991 Doull ..... 206/531
5,014,851 * 5/1991 Wick ..... 206/531
5,394,988 * 3/1995 Edwards et al. ..... 206/5.1
5,620,088 * 4/1997 Martin et al. ..... 206/5.1
5,697,495 * 12/1997 Abrams et al. ..... 206/5.1
6,023,916 * 2/2000 Bouthiette ..... 206/534
6,155,423 * 12/2000 Katzner et al. ..... 206/531

* cited by examiner

*Primary Examiner*—Jim Foster
(74) *Attorney, Agent, or Firm*—John E. Thomas

(57) ABSTRACT

A package assembly includes packages that are connected to a common sheet of lidstock. Various packages are separated from other packages by severing the lidstock between the packages. The packages are supported in depressions in a tray, and the depressions are tapered to facilitate severance of the lidstock.

24 Claims, 5 Drawing Sheets

FIG. 3
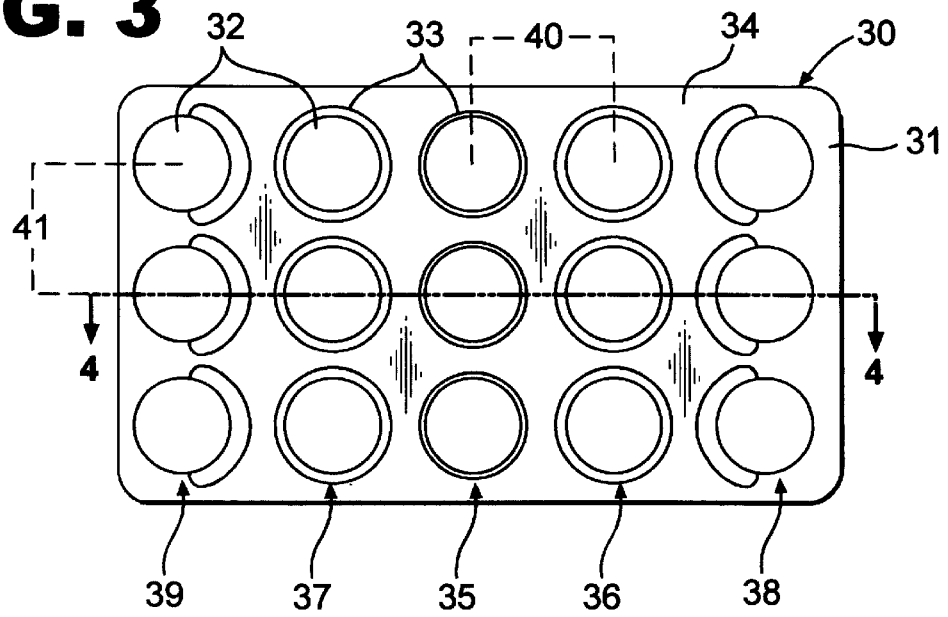
FIG. 4
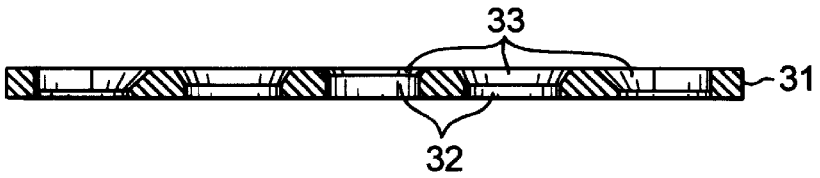
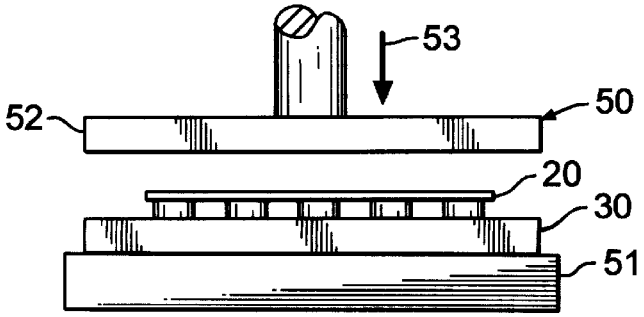
FIG. 5

METHOD FOR SEPARATING PACKAGES

BACKGROUND OF THE INVENTION

This invention relates to a method for separating packages, especially blister packages, that are initially interconnected with a strip or sheet of lidstock material.

A conventional manner of packaging various items, including contact lenses, is in so-called "blister packages". Such packages include a recess designed to hold the item, and the recess is covered with lidstock. In the case of contact lenses, the recess is typically designed to hold an individual lens, with the lens usually being immersed in a saline solution. The packages are then enclosed and sealed with a lidstock, one example being a flexible laminate including a layer of a metal such as aluminum. Frequently, multiple blister packages of contact lenses are then enclosed in a secondary carton, for example, a paperboard box designed to hold a predetermined number of blister packages in a predetermined arrangement.

In manufacturing and assembling packages, it may be desirable to enclose several packages with the same strip or sheet of lidstock, following by severing the lidstock at predetermined locations so to divide the packages and lidstock into smaller segments. One manner of severing the lidstock is with a cutting knife. The present invention provides an improved method of separating the lidstock interconnecting multiple packages that does not rely on a cutting knife.

SUMMARY OF THE INVENTION

This invention provides a method and apparatus for separating packages that are connected to a common sheet of lidstock, such as contact lens blister packages. The invention provides a tray comprising a generally planar member having a top surface with depressions formed therein, wherein each depression is adapted to receive a respective bottom portion of one of the packages, and wherein at least two adjacent depressions terminate at the top surface in tapered annular recesses having different tapers. The respective bottom portions of the packages are pressed into the at least two apertures in the tray to sever the lidstock between the packages.

According to various embodiments, the tray comprises at least two rows of depressions, the depressions in one row terminating in a tapered annular recess having a first taper, and the depressions in the second row termination in a tapered annular recess having a second taper. The annular recesses preferably have a frustoconical shape or a partial frustum shape, and the depressions may extend through the generally planar member to form apertures therein. The adjacent depressions are offset from one another by a different degree than the offset between respective packages that are intended to be separated. For those packages that are not intended to be separated, their respective depressions have the same offset as those packages. The lidstock may include perforated lines, or some other line of weakness, between the adjacent packages to be separated.

According to other embodiments, the tray comprises at least three depressions arranged in a side-by-side arrangement, where each of the at least three depressions terminate at the top surface in tapered annular recesses having different tapers. The depressions may be arranged in at least three rows arranged in a side-by-side arrangement, and each row of depressions has a different taper than an adjacent row of depressions. The lidstock is severed along lines, which are preferably perforated, between these rows.

BRIEF DESCRIPTION OF THE DRAWING FIGURES

FIG. 3 is a top view of a tray for supporting the blister packages of FIG. 2, according to a first embodiment;

FIG. 4 is a cross-sectional view taken along line 4—4 of FIG. 3;

FIG. 5 illustrates a press assembly, employing the tray of FIGS. 3 and 4 and the package assembly of FIG. 2;

Figure 2:
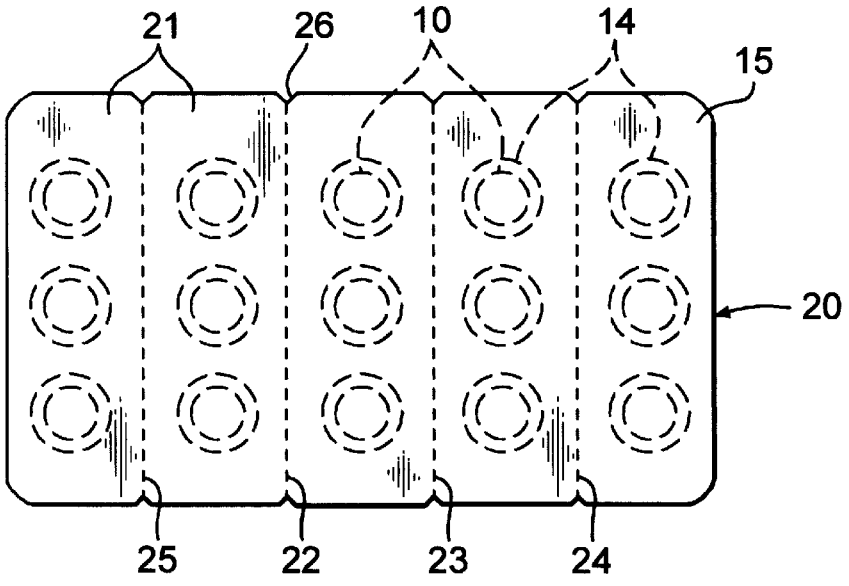
FIG. 2 is a top view of several blister packages interconnected with a single sheet of lidstock material.
Figure 6A:
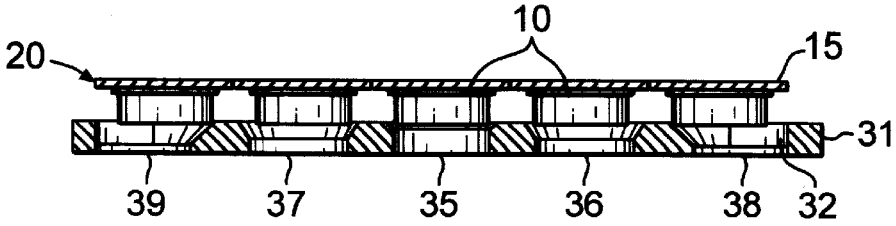
Figure 6B:
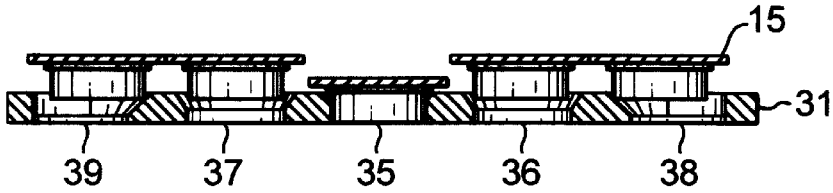
Figure 6C:
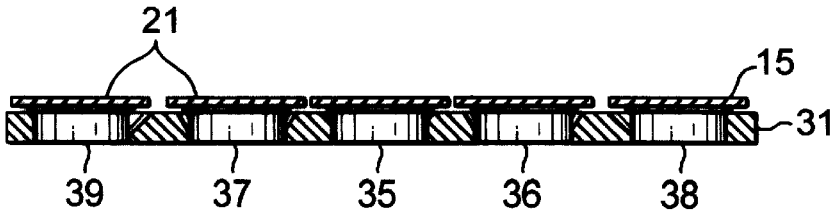
Figure 7:
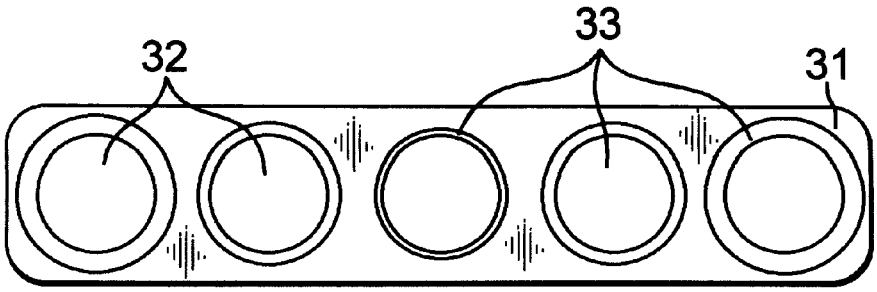
Figure 8:
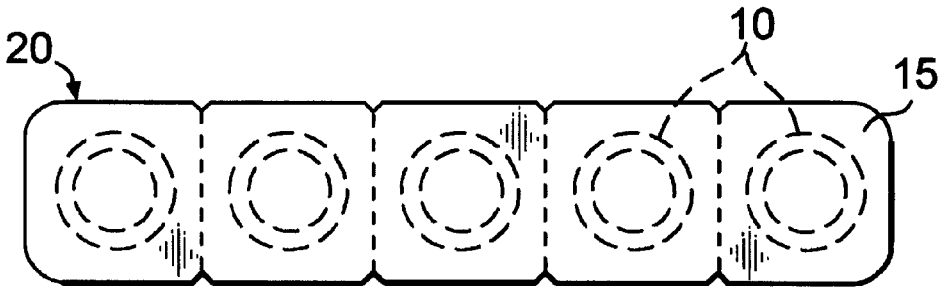
Figure 9:
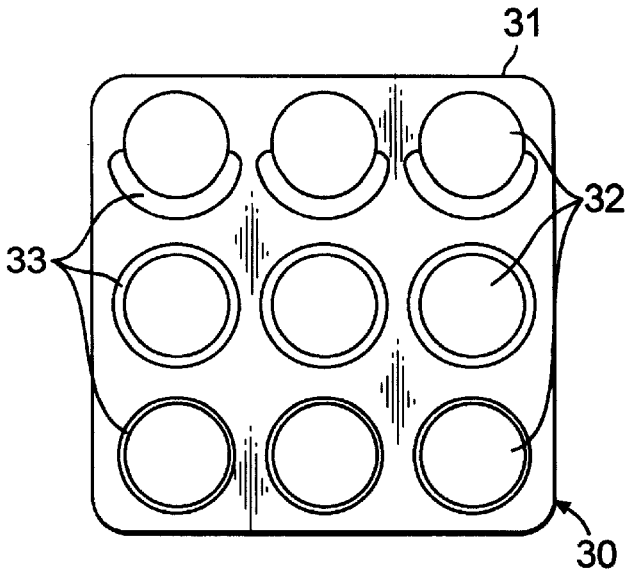
Figure 10:
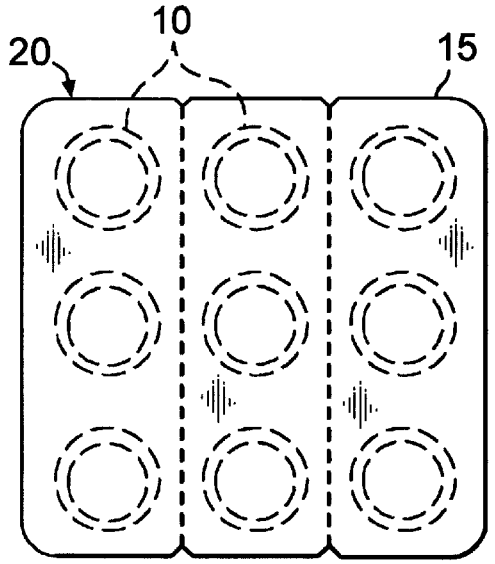

FIGS. 6*a*, 6*b* and 6*c* illustrate various sequential stages in separating the package assembly of FIG. 2 into segments, employing the tray of FIGS. 3 and 4;

FIG. 7 is a top view of a tray adapted for supporting the interconnected packages assembly of FIG. 8;

FIG. 9 is a top view of a tray adapted for supporting the interconnected packages assembly of FIG. 10.

DETAILED DESCRIPTION OF PREFERRED EMBODIMENTS

Figure 1:
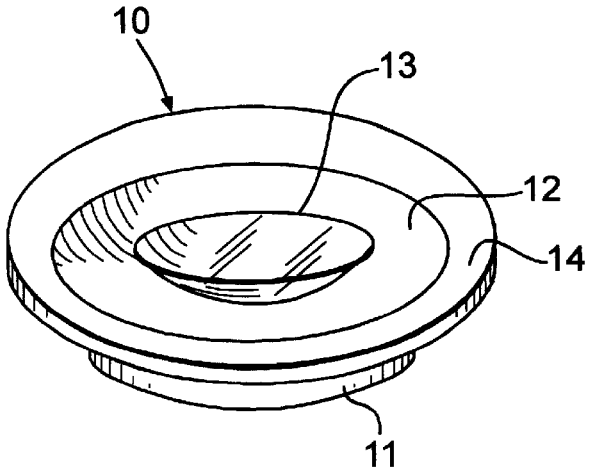
FIG. 1 is a top perspective view of a representative contact lens blister package holding a contact lens.

FIG. 1 illustrates a blister package for contact lenses, it being understood, however, that the invention is applicable to other blister packages. As seen in FIG. 1, contact lens 13 is placed in recess 12 of blister package 10, wherein recess 12 is designed to hold an individual contact lens. Conventionally, recess 12 will also be partially filled with saline solution in the case where the contact lens is a soft hydrogel contact lens. Recess 12 terminates at and is surrounded by surface 14, which is supported above bottom cylindrical member 11.

As seen in FIG. 2, assembly 20 comprises a sheet of lidstock 15 sealed to surfaces 14 of several packages 10, so as to sealingly encase recess 12 and enclose each package. In other words, the function of the lidstock is to sealingly enclose a lens 13 (and saline solution, if present) in each recess 12. For contact lens applications, the sheet of lidstock is conventionally a flexible laminate containing an aluminum layer, such lidstock being sufficiently durable to protect the package contents during shipping and storage and to withstand various other post-packaging operations such as sterilization. In the specific embodiment illustrated in FIG. 2, the single sheet of lidstock 15 is sealed to fifteen packages 10, the packages being arranged in a three-by-five matrix. The sheet 15 of lidstock may be provided initially as a pre-cut sheet of stock lidstock material, or alternately, individual sheets 15 may be cut from a web of stock lidstock material.

The provision of a single sheet of lidstock to seal multiple packages may be useful to reduce material handling, for example, this approach avoids the need to individually seal individual packages with individuals sections of lidstock. Sometimes, however, it is necessary to separate the packages interconnected with the single sheet of lidstock into smaller segments for retail. One manner of separating the package assembly into smaller segments would be to cut the lidstock with a cutting knife. The present invention provides a novel method of separating the package assembly into smaller segments while maintaining integrity of the seal between the lidstock and individual packages, i.e., integrity of the seal between lidstock 15 to surface 14 in the illustrated embodiment.

Tray 30 illustrated in FIGS. 3 and 4 is adapted for separating the fifteen packages of the assembly 20 shown in FIG. 2, into five segments 21, with each segment 21 including three blister packages 10. In other words, the sheet of lidstock is to be severed along lines 22, 23, 24, 25. Preferably, lines 22, 23, 24, 25 include perforations to facilitate the severing of lidstock 15. Optionally, the lidstock may include generally V-shaped cut-outs 26 so that when the lidstock sheet 15 is severed along lines 22, 23, 24, 25, the foil on the resultant segments 21 does not have sharp comers.

Tray 30 includes a generally planar member 31 having a top surface 34 with fifteen depressions 32 formed in the top surface, such that each depression corresponds to one of the packages 10 in assembly 20. In the illustrated embodiments, the depressions have the form of apertures extending entirely through member 31, although it is possible that the depressions terminate in a bottom, so long as the depressions have sufficient depth to receive and support a bottom portion of a package. In the embodiment illustrated in FIGS. 3 and 4, these apertures 32 may be grouped into five rows 35, 36, 37, 38 and 39. Each aperture 32 has a diameter slightly larger than, but closely corresponding to, the outer diameter of the package bottom cylindrical portion 11. As mentioned, a primary purpose of the apertures or depressions 32 is to secure its respective package when the package bottom portion is received therein. Accordingly, in the case where the package has a shape or configuration different from the illustrated embodiment, a main consideration is that the depression or aperture has a size and shape to receive and secure the bottom portion of the package.

In the illustrated embodiment, each aperture 32 terminates at the top surface 34 of planar member 31 with a tapered annular recess 33 that at least partially surrounds the aperture. Stated differently, each aperture 32 is at least partially surrounded by a tapered recess 33 at the top surface 34. For example, in the illustrated embodiment, the apertures 32 in rows 35, 36 and 37 are completed surrounded by a tapered annular recess 33 having a frustoconical shape; the apertures in rows 38 and 39 are only partially surrounded by a tapered recess 33 having the shape of a partial frustum. In the illustrated embodiment, the apertures 32 extend entirely through planar member 31, whereas these tapered recesses 33 are formed only in the top surface of planar member 31 and do not extend completely through planar member 31, although alternate configurations are possible.

As seen in FIGS. 3 and 4, the diameters of the recesses in rows 36 and 37 at the top surface of planar member 31 are slightly larger than the diameters of the recesses in row 35, and the diameters of the recesses in rows 38 and 39 at the top surface of planar member 31 are slightly larger than the diameters of the recesses in rows 36 and 37. Also, as seen in FIG. 4, the tapered recesses of row 35 do not extend as deeply as those in rows 36 and 37, and the tapered recesses of rows 36 and 37 do not extend as deeply as those in rows 38 and 39. In other words, the recesses in row 35 have the same a certain taper, the recesses in rows 36 and 37 have a different taper, and the recesses in rows 38 and 39 have yet another taper. In contrast, all the apertures within row 35 have the same taper, similar to rows 36, 37 and to rows 38, 39.

Also, the separation between the centers of the apertures in adjacent rows (for example, the separation 40 between the centers of the apertures in rows 35 and 36) is slightly smaller than the separation between the centers of the respective packages. In other words, the rows of apertures in the tray have a greater offset (or pitch) than the rows of packages in the package assembly. In contrast, all the apertures within row 35 (or within rows 36, 37, or within rows 38, 39) have an offset 41 (or pitch) that is similar to the offset (or pitch) between their respective packages. As an example, in the case where the centers of package portions 11 are offset by 29.5 mm, the aperture centers between rows 35 and 36, and between rows 36 and 38, may be offset by 30.5 mm; the aperture centers within row 35 would be offset from one another by about 29.5 mm.

In FIG. 5, the packages and lidstock assembly 20 of FIG. 2 is supported on tray 30, and tray 30 is supported on a support 51 of press assembly 50. The press assembly includes a presser member 52, and when this member 52 is moved in the direction of arrow 53, member 52 contacts and exerts pressure on assembly 20, forcing the individual packages into the corresponding apertures 32 of tray 30, as described in more detail below. Presser member 52 may have the form of a plate with a planar surface that contacts the lidstock 15, or presser member 52 may have depressions in its contacting surface corresponding to the recesses 12 of package 10, for example, so that the presser member 52 mainly contacts the lidstock in the vicinity of surfaces 15 and not in the vicinity of recesses 12. The press assembly 50 may be manually operated. For example, presser member 52 may be connected to a handle via a lever (such that depression of the handle by an operator moves presser member 52 in the direction of arrow 53), or via a pneumatic cylinder (such that depression of the handle by an operator activates the pneumatic cylinder to move presser member 52 in the direction of arrow 53). Alternately, the press assembly may be automated, for example, employing a pneumatic or electrical actuator.

More specifically, FIG. 6*a* illustrates an appropriate position of the assembly 20 on tray 30, prior to presser member 52 exerting pressure thereon, such as the initial configuration shown in FIG. 5. It can be seen that the cylindrical member 11 of each package 10 is aligned with its corresponding tapered recess 33. The tapered surfaces of the recesses 33 assist in aligning the packages for this initial positioning. The package cylindrical portions 11 are substantially centrally aligned with the apertures 32 in row 35, whereas the package cylindrical portion are not centrally aligned with the respective apertures in rows 36, 37, 38 and 39. Although it is not critical that the apertures in row 35 include a tapered recess, it is preferred that all apertures include such a recess to facilitate this initial aligning of the package assembly 20 with the tray 30.

Next, initial pressure is applied by presser member 52 so as to force the assembly 20 towards tray 30. The package cylindrical portions 11 in row 35 are received in the apertures 32 of row 35 and secured sufficiently therein to prevent substantial lateral movement of these packages; concurrently, the packages in rows 36, 37, 38 and 39, guided by the tapered recesses in these rows, are forced laterally away from the packages in row 35. This results in severance of the sheet of lidstock 35 along lines 22 and 23, so that the packages in row 35 are free to fall fully into their apertures, and the package assembly assumes the general configuration shown in FIG. 6*b*. The tapered recesses in rows 38 and 39 guide their corresponding packages towards their apertures, but because the tapered recesses in rows 38 and 39 are not as steep as the tapered recesses in rows 36 and 37, the force between the corresponding packages in these rows is not as great at this point, and these packages will not have separated yet along lines 24 and 25.

The application of additional pressure by presser member 52 forces the assembly closer to tray 30. Accordingly, the package bottom portions 11 in rows 36 and 37 are received into and secured against lateral movement by their respective apertures 32 in rows 36 and 37, while the packages supported in rows 38 and 39, guided by the tapered recesses in these rows, are forced laterally away from the packages in rows 36 and 37. This results in severance of the lidstock 35 along lines 24 and 25, so that the package assembly assumes the general configuration shown in FIG. 6*c*. This resultant structure for the described embodiment is five strips 21 (or segments) of three blister packages which, if desired, may be placed in secondary packaging such as a paperboard carton.

FIG. 7 illustrates another configuration of tray 30 that is adapted for separating the packages 10 of the package assembly 20 shown in FIG. 8. In FIG. 8, the lidstock sheet 15 has the form of a strip that interconnects five packages 10. Accordingly, the tray shown in FIG. 7 can be used to sever the lidstock so as to provide five individual packages. FIG. 9 illustrates yet another configuration of tray 30 that is adapted for separating the packages 10 of the package assembly 20 shown in FIG. 10. In FIG. 10, the lidstock sheet 15 interconnects nine packages arranged in a three-by-three matrix. Accordingly, the tray shown in FIG. 9 can be used to sever the lidstock so as to provide three segments, each segment containing three packages. As evident from FIG. 9, it is not necessary that the row of apertures 32 having the smallest tapered recesses 33 is centrally located with respect to the remaining rows of apertures.

Many other modifications and variations of the present invention will be evident to the skilled practitioner. For example, as mentioned above, the invention is applicable to other blister packages than those shown in the figures. It is therefore understood that, within the scope of the claims, the present invention is not limited to the described preferred embodiments and can be practiced other than as herein specifically described.

We claim:

1. A combination comprising:

a package assembly comprising packages that are connected to a common sheet of lidstock; and a tray comprising a generally planar member having a top surface with depressions formed therein, wherein each depression is adapted to receive a respective bottom portion of one of said packages, and wherein at least two adjacent depressions terminate at the top surface in tapered annular recesses having different tapers.

2. The combination of claim 1, further comprising a press for pressing the packages into the depressions in the tray.

3. The combination of claim 2, further comprising a support for supporting the tray.

4. The combination of claim 1, wherein the tray comprises at least two rows of depressions, the depressions in one row terminating in a tapered annular recess having a first taper, and the depressions in the second row termination in a tapered annular recess having a second taper different from the first taper.

5. The combination of claim 1, wherein the annular recesses have a frustoconical shape or a partial frustum shape.

6. The combination of claim 1, wherein said at two adjacent depressions are offset from one another by a different degree than an offset between respective packages attached to the lidstock.

7. The combination of claim 1, wherein the lidstock has perforated lines therein.

8. The combination of claim 1, wherein the tray comprises at least three depressions arranged in a side-by-side arrangement, and each of the at least three depressions terminate at the top surface in tapered annular recesses having different tapers.

9. The combination of claim 8, wherein the at least three depressions extend through the generally planar member to form apertures therein.

10. The combination of claim 9, wherein the tray comprises at least three rows of apertures arranged in a side-by-side arrangement, and wherein the apertures in each of the at least three rows terminate at the top surface in tapered annular recesses, and each row of apertures has a different taper than an adjacent row of apertures.

11. The combination of claim 10, wherein the tapered annular recesses in a first row of apertures have a first frustoconical shape.

12. The combination of claim 11, wherein the tapered recesses in a second row of apertures have a second frustoconical shape different from the first frustoconical shape.

13. The combination of claim 10, wherein the tapered recesses in at least one row of apertures have a partial frustum shape.

14. The combination of claim 1, wherein the packages are contact lens blister packages.

15. A method comprising:

providing a package assembly comprising packages that are connected to a common sheet of lidstock;

providing a tray comprising a generally planar member having a top surface with depressions formed therein, wherein at least two adjacent depressions terminate at the top surface in tapered annular recesses having different tapers; and pressing respective bottom portions of the packages into said at least two apertures in the tray and severing the lidstock between said packages.

16. The method of claim 15, wherein the tray comprises at least two rows of depressions, the depressions in one row terminating in a tapered annular recess having a first taper, and the depressions in the second row termination in a tapered annular recess having a second taper, and wherein the lidstock is severed in a manner to separate respective packages in said at least two rows.

17. The method of claim 15, wherein the annular recesses have a frustoconical shape or a partial frustum shape.

18. The method of claim 15, wherein the lidstock has perforated lines therein, and the lidstock is severed along the perforated lines.

19. The method of claim 15, wherein the tray comprises at least three depressions arranged in a side-by-side arrangement, where each of the at least three depressions terminate at the top surface in tapered annular recesses having different tapers.

20. The method of claim 19, wherein the at least three depressions extend through the generally planar member to form apertures therein.

21. The method of claim 19, wherein the tray comprises at least three rows of apertures arranged in a side-by-side arrangement, and wherein the apertures in each of the at least three rows terminate at the top surface in tapered annular recesses and each row of apertures has a different taper than an adjacent row of apertures, and wherein the lidstock is severed between the respective rows of packages.

22. The method of claim 21, wherein the tapered annular recesses in a first row of apertures have a first frustoconical shape, and the tapered recesses in a second row of apertures have a second frustoconical shape different from the first frustoconical shape.

23. The method of claim 21, wherein the rows of apertures are offset from one another by a different degree than an offset between rows of respective packages attached to the lidstock.

24. The method of claim 15, wherein the packages are contact lens blister packages.

* * * * *